US006253737B1

(12) United States Patent
Radue

(10) Patent No.: US 6,253,737 B1
(45) Date of Patent: Jul. 3, 2001

(54) DIRECT FUEL INJECTION USING A FUEL PUMP DRIVEN BY A LINEAR ELECTRIC MOTOR

(75) Inventor: Martin L. Radue, Kenosha, WI (US)

(73) Assignee: Bombardier Motor, Grant, FL (US)

( * ) Notice: Subject to any disclaimer, the term of this patent is extended or adjusted under 35 U.S.C. 154(b) by 0 days.

(21) Appl. No.: 09/539,254

(22) Filed: Mar. 30, 2000

(51) Int. Cl.[7] ..... F02M 33/04; F04B 17/04
(52) U.S. Cl. ..... 123/499; 417/417; 123/456
(58) Field of Search ..... 123/498, 499, 123/456; 417/417, 490, 499

(56) References Cited

U.S. PATENT DOCUMENTS 3,044,401 * 7/1962 Sawyer ..... 417/417
3,851,635 * 12/1974 Murtin et al. ..... 123/499
4,116,591 * 9/1978 Mardell ..... 417/417
4,227,499 * 10/1980 Brinkman ..... 123/499
4,266,523 * 5/1981 Brinkman ..... 123/499
4,312,316 * 1/1982 Seilly et al. ..... 123/499
4,787,823 * 11/1988 Hultman ..... 417/417
5,562,428 * 10/1996 Bailey et al. ..... 417/417
5,779,454 * 7/1998 Binversie et al. ..... 123/499

* cited by examiner

*Primary Examiner*—Thomas N. Moulis
(74) *Attorney, Agent, or Firm*—Fletcher, Yoder & Van Someren

(57) ABSTRACT

A fuel delivery system for an internal combustion engine having a plurality of combustion chambers. The fuel delivery system includes a source of fuel, a fuel pump driven by a linear electric motor, a plurality of fluid actuators and a plurality of fuel delivery assemblies. The fuel pump driven by a linear electric motor draws fuel from the source of fuel and pumps the fuel to the plurality of fluid actuators. The fluid actuators direct the fuel to fuel delivery assemblies. The fuel delivery assemblies receive the fuel from the fluid actuators and deliver the fuel to combustion chambers. The fuel delivery system includes a control system that controls the operation of the fuel delivery system to provide desired volumes of fuel at desired flow rates to the combustion chambers.

25 Claims, 6 Drawing Sheets

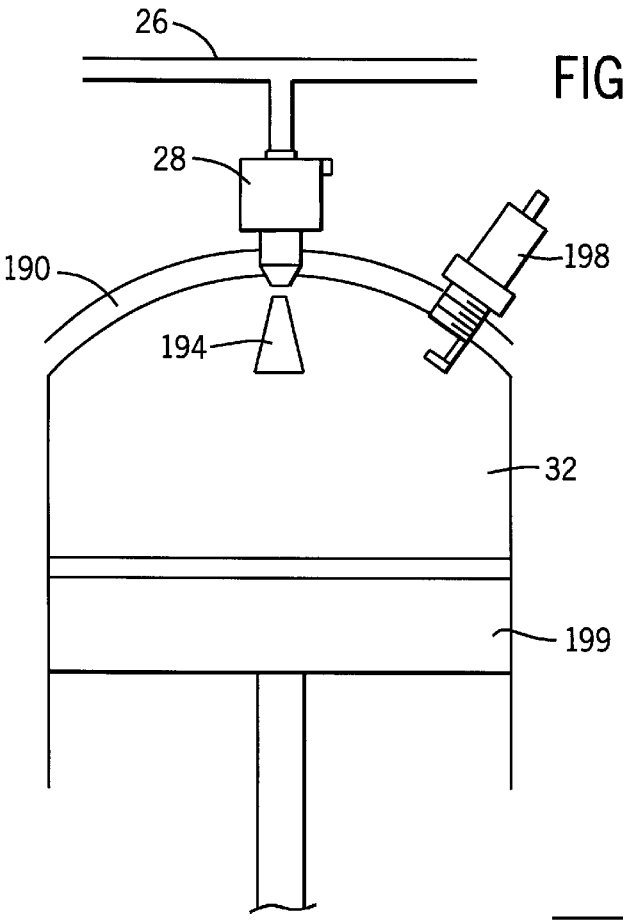
FIG. 4
FIG. 5
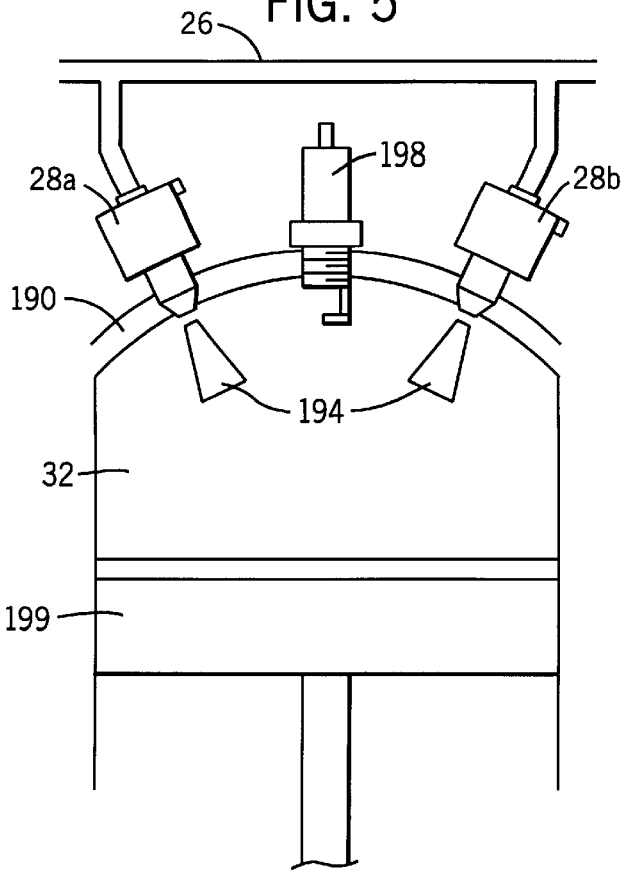

DIRECT FUEL INJECTION USING A FUEL PUMP DRIVEN BY A LINEAR ELECTRIC MOTOR

BACKGROUND OF THE INVENTION

1. Field of the Invention

The present invention relates generally to a system and method for delivering fuel for combustion in an internal combustion engine. More specifically, the present invention relates to a system and method for utilizing a fuel pump driven by a linear electric motor to provide fuel to a plurality of fuel delivery assemblies for delivery to a plurality of cylinders within an internal combustion engine.

2. Description of the Related Art

Generally, an internal combustion engine ignites a mixture of air and combustible fuel within one or more combustion chambers to provide rotational motive force, or torque, to do work. Along with many other factors, optimal performance of an internal combustion engine is dependent upon an adequate supply of fuel for combustion. Two measures of engine performance are illustrative of this dependency: engine torque and engine speed (in revolutions per minute). Generally, the torque produced is proportional to the volume of fuel combusted during a given combustion cycle. That is, under proper conditions, the greater the volume of fuel combusted the greater the force produced from the combustion.

For most applications an engine must be able to provide torque at various speeds as well. For engine speed to increase the flow rate of fuel to the combustion chambers must also increase. Increasing the speed of the engine, however, shortens the time for each combustion cycle. Thus, a fuel delivery system must provide fuel for each combustion cycle at increasingly faster rates as the engine speed is increased. Engine torque and speed can both be limited by the inability of the fuel delivery system to provide fuel at these increasingly faster rates. Engine torque can be limited by an inability to supply the engine with a sufficient volume of fuel for the combustion cycle. Engine speed can be limited by the inability to supply the required volumes of fuel at the needed rate.

In addition to combustible fuel, oxygen is also necessary for combustion. There are various methods of providing fuel and oxygen for combustion to a combustion chamber. The surrounding air, typically, acts as the source of oxygen. An air intake draws in the surrounding air, which is mixed with the fuel. Some delivery systems mix air and fuel before the two substances are delivered to the combustion chamber. Alternatively, the fuel and air can be delivered separately and mixed within the combustion chamber. Some systems use carburetors to draw fuel vapor into an air stream that is then fed into the combustion chamber, while other systems use fuel injection to produce fuel vapor from a liquid fuel spray.

There are many current systems and methods of fuel injection. Typically, a programmable logic device controls the operation of the fuel injection system. One or more pumps are used to produce a source of pressurized fuel. A fluid actuator, sometimes a solenoid operated valve, initiates a flow of pressurized fuel to an injection nozzle. In other applications the fluid actuators include a pump that produces a surge in fuel pressure. The surge in fuel pressure causes an injection nozzle to open, allowing pressurized fuel to flow through the injection nozzle. The shape of the outlet of the injection nozzle contributes to the atomization of the fuel as it exits the injection nozzle. Still other fuel injection systems use an integrated pump and injection nozzle assembly.

One method of fuel injection is direct fuel injection. In direct fuel injection liquid fuel under pressure is injected by a fuel injector directly into a cylinder before combustion is initiated in the cylinder by a spark plug. The fuel injection system converts the liquid fuel into an atomized fuel spray. The atomization of the liquid fuel effectively produces fuel vapor, aiding in the ignition of the vapor during combustion in the cylinder. Increasing the pressure of the fuel also increases the atomization of the fuel when injected into a cylinder.

Typically, the fuel delivery system is sized to provide adequate fuel volumes and flow rates for the normal expected range of engine torque and power needs. However, the fuel delivery system may be unable to supply the fuel volumes and rates at engine speeds, torque and power levels above the normal expected range. Thus, it may arise that engine torque, speed and power are limited by the ability of the fuel delivery system to supply fuel for combustion. This is particularly the case when fuel delivery systems for one type of engine are applied to higher performance engines, with correspondingly higher fuel volume and flow rate requirements dictated by higher torque, speed and power capabilities.

There is a need, therefore, for an improved technique for supplying combustible fuel in internal combustion engines which can be readily adapted to various engine configurations and performance capabilities. There is a particular need for a technique for fuel injection systems that can supply the higher volumetric (i.e. volume per cycle) and flow rate requirements of high performance engines, while permitting manufactures and designers to draw upon certain existing injection system designs and components.

The present invention relates generally to a fuel injection system. More specifically, the present invention relates to a fuel injection system using a fluid pump driven by a linear electric motor to provide fuel to a plurality of combustion chambers or cylinders.

SUMMARY OF THE INVENTION

The invention provides a fuel delivery system for an internal combustion engine having a plurality of combustion chambers. The fuel delivery system includes a source of fuel, a fuel pump driven by a linear electric motor, a plurality of fluid actuators and a plurality of fuel delivery assemblies. The fuel pump pumps fuel from the source of fuel to the plurality of fluid actuators. Each fluid actuator directs the fuel to a respective fuel delivery assembly. The fuel delivery system also includes a control system that controls the operation of the fuel delivery system to provide desired volumes of fuel at desired flow rates to the combustion chambers.

According to another aspect of the invention, an internal combustion engine is featured that includes a source of fuel, a common fuel supply line, and a fuel pump driven by a linear electric motor. The fuel pump driven by a linear electric motor draws in fuel from the source of fuel and pumps the fuel to the common fuel supply line. The system also includes a plurality of fluid actuators, a plurality of fuel delivery assemblies, and a plurality of combustion chambers. A fluid actuators is coupled to the common fuel supply line and directs the fuel from the common supply line to a respective fuel delivery assembly. The fuel delivery assembly delivers the fuel to a respective combustion chamber. The system also includes a control system that controls the operation of the fuel delivery system to provide fuel to the plurality of combustion chambers.

According to another aspect of the present invention, a method is featured for supplying fuel to an internal combustion engine. The method includes the steps of operating a linear electric motor to drive a fuel pump to pump fuel from a source of fuel to a common fuel supply line. The method also includes operating fluid actuators to provide desired fuel flow rates or fuel volumes from the supply line to combustion chambers for combustion. The method preferably utilizes a respective fuel delivery assembly to deliver the fuel provided by each of the fluid actuators to a respective combustion chamber.

BRIEF DESCRIPTION OF THE DRAWINGS

The foregoing and other advantages of the invention will become apparent upon reading the following detailed description and upon reference to the drawings in which:

FIG. 4 is a diagrammatical view of an embodiment of a fuel delivery system utilizing a single fluid actuators and a single fuel delivery assembly in each cylinder;

FIG. 5 is a diagrammatical view of an embodiment of a fuel delivery system utilizing a single fluid actuator and two fuel delivery assemblies in each cylinder;

DETAILED DESCRIPTION OF SPECIFIC EMBODIMENTS

Figure 1:
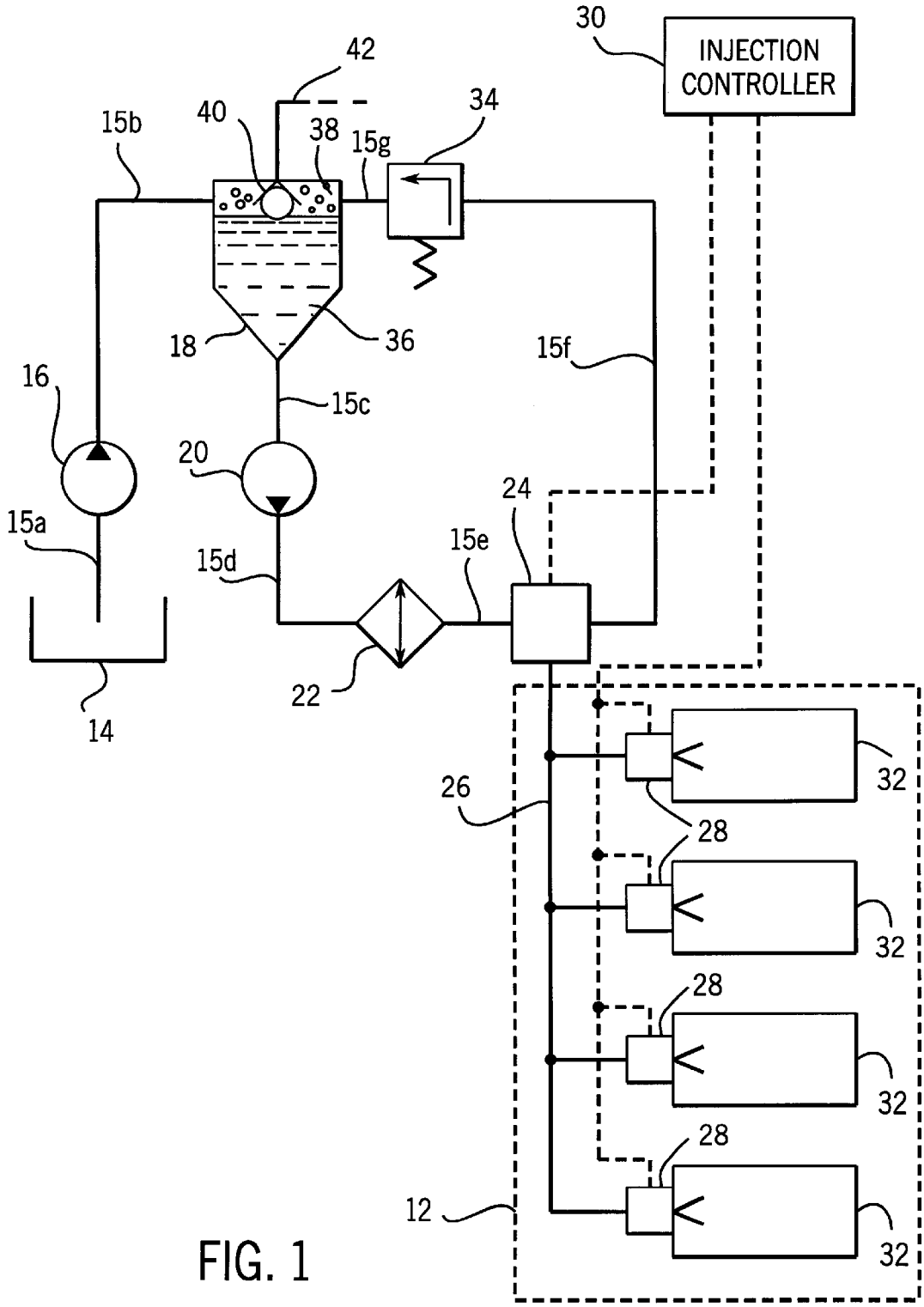
FIG. 1 is a schematic representation of a fuel delivery system utilizing a single fluid actuator to provide fuel to a plurality of combustion chambers or cylinders in accordance with certain aspects of the present technique.

Turning now to the drawings and referring first to FIG. 1, a schematic representation is shown of a fuel delivery system 10 for an internal combustion engine 12 utilizing a fuel pump driven by a linear electric motor to provide fuel to a plurality of cylinders. In the illustrated embodiment, the fuel delivery system 10 includes, a fuel tank 14, various fuel lines 15, a first fuel pump 16, a gas separation chamber 18, a second fuel pump 20, a fuel filter 22, a fuel pump driven by a linear electric motor 24, a fuel rail 26, a plurality of fluid actuators 28, an injection controller 30, a plurality of cylinders 32, a pressure regulator 34, a float valve 40, and a ventilation line 42. The fluid actuators 28 also serve as fuel delivery assemblies.

Fuel for combustion is stored in the fuel tank 14. A first fuel line 15*a* conveys fuel from the fuel tank 14 to a first fuel pump 16. The first fuel pump 16 draws fuel from the fuel tank 16 and pumps the fuel through a second fuel line 15*b* to a gas separation chamber 18. Fuel flows from the gas separation chamber 18 through a third fuel line 15*c* at or near the bottom of the gas separation chamber 18. The fuel is coupled to a second fuel pump 20 that pumps fuel through a fourth fuel line 15*d* to a fuel filter 22. Fuel flows from the fuel filter 22 through a fifth fuel line 15*e* to the fuel pump driven by a linear electric motor 24. From the fuel pump driven by a linear electric motor 24 fuel flows along a fuel rail 26 to a plurality of fluid actuators 28. The fluid actuators 28 are electrically operated by an injection controller 30. The injection controller 30 operates the fluid actuators 28 to direct fuel to the cylinders 32.

The fuel pump driven by a linear electric motor 24 is a pressure surge pump that produces continuous pulses of pressurized fuel. The injection controller 30 determines the proper fuel flow rate and fuel volume per engine cycle based on demand. The injection controller 30 then operates the fuel pump driven by a linear electric motor 24 to maintain the desired fuel pressure in the fuel rail 26, as well as operating the fluid actuators 28 to provide the proper fuel to each cylinder 32. In the illustrated embodiment, each cylinder 32 receives fuel from the fuel rail 26 through a single fluid actuator 28.

Fuel that is not used for combustion is used to carry away heat and any fuel vapor bubbles or gases from the fuel pump driven by a linear electric motor 24. This portion of fuel not used in combustion flows from the fuel pump driven by a linear electric motor 24 through a sixth fuel line 15*f* to a pressure regulator 34. A seventh fuel line 15*g* couples fuel from the pressure regulator 34 to the gas separation chamber 18. Liquid fuel 36 and gas/fuel vapor 38 collects in the gas separation chamber 18. A float valve 40 within the gas separation chamber 18 maintains the desired level of liquid fuel 36 in the gas separation chamber 18. The float valve 40 consists of a float that operates a ventilation valve coupled to a ventilation line 42. The float rides on the liquid fuel 36 in the gas separation chamber 18 and closes the ventilation valve when the float rises to a predetermined level. The flow of fuel into the gas separation chamber is regulated by the opening and closing of the ventilation valve. The ventilation valve opens as fuel demand or utilization lowers the fuel level in the gas separation chamber 18, again, regulating the flow of fuel from the fuel tank 14 into the gas separation chamber 18.

Figure 2:
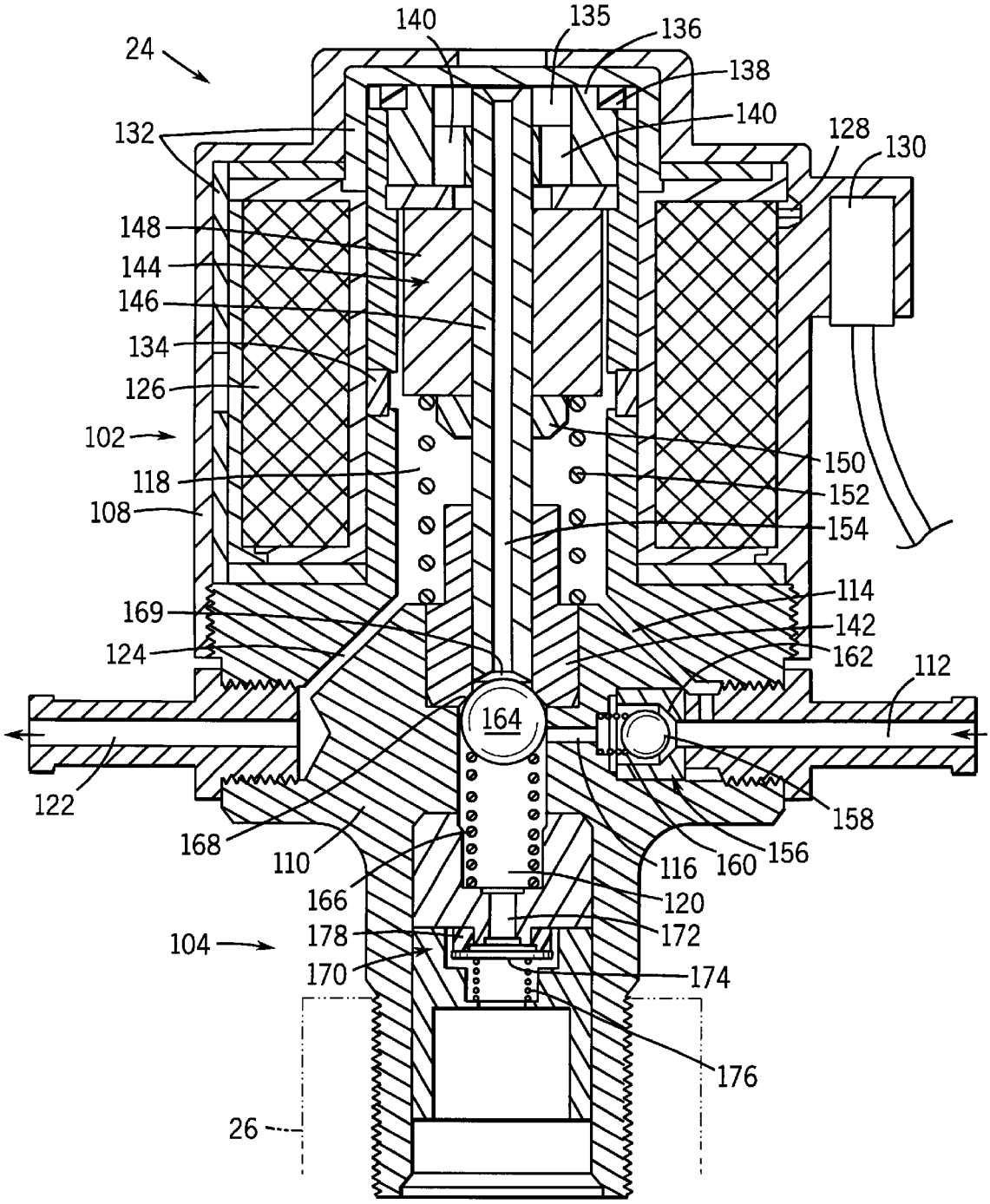
FIG. 2 is a cross-sectional view of a fluid actuator for use in the system of FIG. 1 at a point during the charging cycle in accordance with a preferred embodiment.

Referring to FIG. 2, an embodiment is shown of an exemplary fuel pump driven by a linear electric motor 24. The fuel pump driven by a linear electric motor 24 is composed of two primary subassemblies: a drive section 102 and a pump section 104. The drive section 102 is contained within a solenoid housing 108. A pump housing 110 serves as the base for both the drive section 102 and the pump section 104 of the fluid actuator 24.

The drive section 102 incorporates a linear electric motor. In the illustrated embodiment, the linear electric motor is a reluctance motor. In the present context, reluctance is the opposition of a magnetic circuit to the establishment or flow of a magnetic flux. A magnetic field and circuit are produced in the reluctance motor by electric current flowing through a coil 126. The coil 126 receives power from the injection controller 30 (see FIG. 1). The coil 126 is electrically coupled by leads 128 to a receptacle 130. The receptacle 130 is coupled by conductors (not shown) to the injection controller 30. Magnetic flux flows in a magnetic circuit 132 around the exterior of the coil 126 when the coil is energized. The magnetic circuit 132 is composed of a material with a low reluctance, typically a magnetic material, such as ferromagnetic alloy, copper or other magnetically conductive materials. A gap in the magnetic circuit 132 is formed by a reluctance gap spacer 134 composed of a material with a relatively higher reluctance than the magnetic circuit 132, such as synthetic plastic.

A fluid brake or cushion within the fuel pump driven by a linear electric motor 24 acts to slow the upward motion of the moving portions of the drive section 102 once reciprocating motion begins during operation. For this purpose, the upper portion of the solenoid housing 108 is shaped to form a recessed cavity 135. An upper bushing 136 separates the recessed cavity 135 from the armature chamber 118 and provides support for the moving elements of the drive section at the upper end of travel. A seal 138 is located between the upper bushing 136 and the solenoid housing 108 to ensure that the only flow of fuel from the armature chamber 118 to and from the recessed cavity 135 is through fluid passages 140 in the upper bushing 136. The moving portions of the drive section 102 will displace fuel from the an nature chamber 118 into the recessed cavity 135 during the period of upward motion. Flow of fuel through the fluid passageways 140 is restricted somewhat to produce a cushioning effect. The restricted flow of fuel acts as a brake on upward motion. A lower bushing 142 is included to provide support for the moving elements of the drive section at the lower travel limit and to seal the pump section from the drive section.

A reciprocating assembly 144 forms the linear moving elements of the reluctance motor. The reciprocating assembly 144 includes a guide tube 146, an armature 148, a centering element 150 and a spring 152. The guide tube 146 is supported at the upper end of travel by the upper bushing 136 and at the lower end of travel by the lower bushing 142. An armature 148 is attached to the guide tube 146. The armature 148 sits atop a biasing spring 152 that opposes the downward motion of the armature 148 and surge tube 146, and maintains the guide tube and armature in an upwardly biased or retracted position. Centering element 150 keeps the spring 152 and armature 148 in proper centered alignment. The guide tube 146 has a central passageway 154 which permits the flow of a small volume of fuel when the surge tube 146 moves a given distance through the armature chamber 118 as described below. Flow of fuel through the guide tube 146 permits its acceleration in response to energization of the coil during operation.

When the coil 126 is energized, the magnetic flux field produced by the coil 126 seeks the path of least reluctance. The armature 148 and the magnetic circuit 132 are composed of a material of relatively low reluctance. The magnetic flux lines will thus extend around coil 126 and through magnetic circuit 132 until the magnetic gap spacer 134 is reached. The magnetic flux lines will then extend to armature 148 and an electromagnetic force will be produced to drive the armature 148 downward towards alignment with the reluctance gap spacer 134. When the flow of electric current is removed from the coil by the injection controller 30, the magnetic flux will collapse and the force of spring 152 will drive the armature 148 upwardly and away from alignment with the reluctance gap spacer 134. Cycling the electrical control signals provided to the coil 126 produces a reciprocating linear motion of the armature 148 and guide tube 146 by the upward force of the spring 152 and the downward force produced by the magnetic flux field on the armature 148.

The second fuel flow path provides the fuel for pumping and, ultimately, for combustion. The drive section 102 provides the motive force to drive the pump section 104 to produce a surge of pressure that forces fuel through the nozzle 106. As described above, the drive section 102 operates cyclically to produce a reciprocating linear motion in the guide tube 146. During a charging phase of the cycle, fuel is drawn into the pump section 104. Subsequently, during a discharging phase of the cycle, the pump section 104 pressurizes the fuel and discharges the fuel through the nozzle 106, such as directly into a combustion chamber 32 (see FIG. 1).

During the charging phase fuel enters the pump section 104 from the inlet 112 through an inlet check valve assembly 156. The inlet check valve assembly 156 contains a ball 158 biased by a spring 160 toward a seat 162. During the charging phase the pressure of the fuel in the fuel inlet 112 will overcome the spring force and unseat the ball 158. Fuel will flow around the ball 158 and through the second passageway 116 into the pump chamber 120. During the discharging phase the pressurized fuel in the pump chamber 120 will assist the spring 160 in seating the ball 158, preventing any reverse flow through the inlet check valve assembly 156.

A pressure surge is produced in the pump section 104 when the guide tube 146 drives a pump sealing member 164 into the pump chamber 120. The pump sealing member 164 is held in a biased position by a spring 166 against a stop 168. The force of the spring 166 opposes the motion of the pump sealing member 164 into the pump chamber 120. When the coil 126 is energized to drive the armature 148 towards alignment with the reluctance gap spacer 134, the guide tube 146 is driven towards the pump sealing member 164. There is, initially, a gap 169 between the guide tube 146 and the pump sealing member 164. Until the guide tube 146 transits the gap 169 there is essentially no increase in the fuel pressure within the pump chamber 120, and the guide tube and armature are free to gain momentum by flow of fuel through passageway 154. The acceleration of the guide tube 146 as it transits the gap 169 produces the rapid initial surge in fuel pressure once the surge tube 146 contacts the pump sealing member 164, which seals passageway 154 to pressurize the volume of fuel within the pump chamber.

Figure 3:
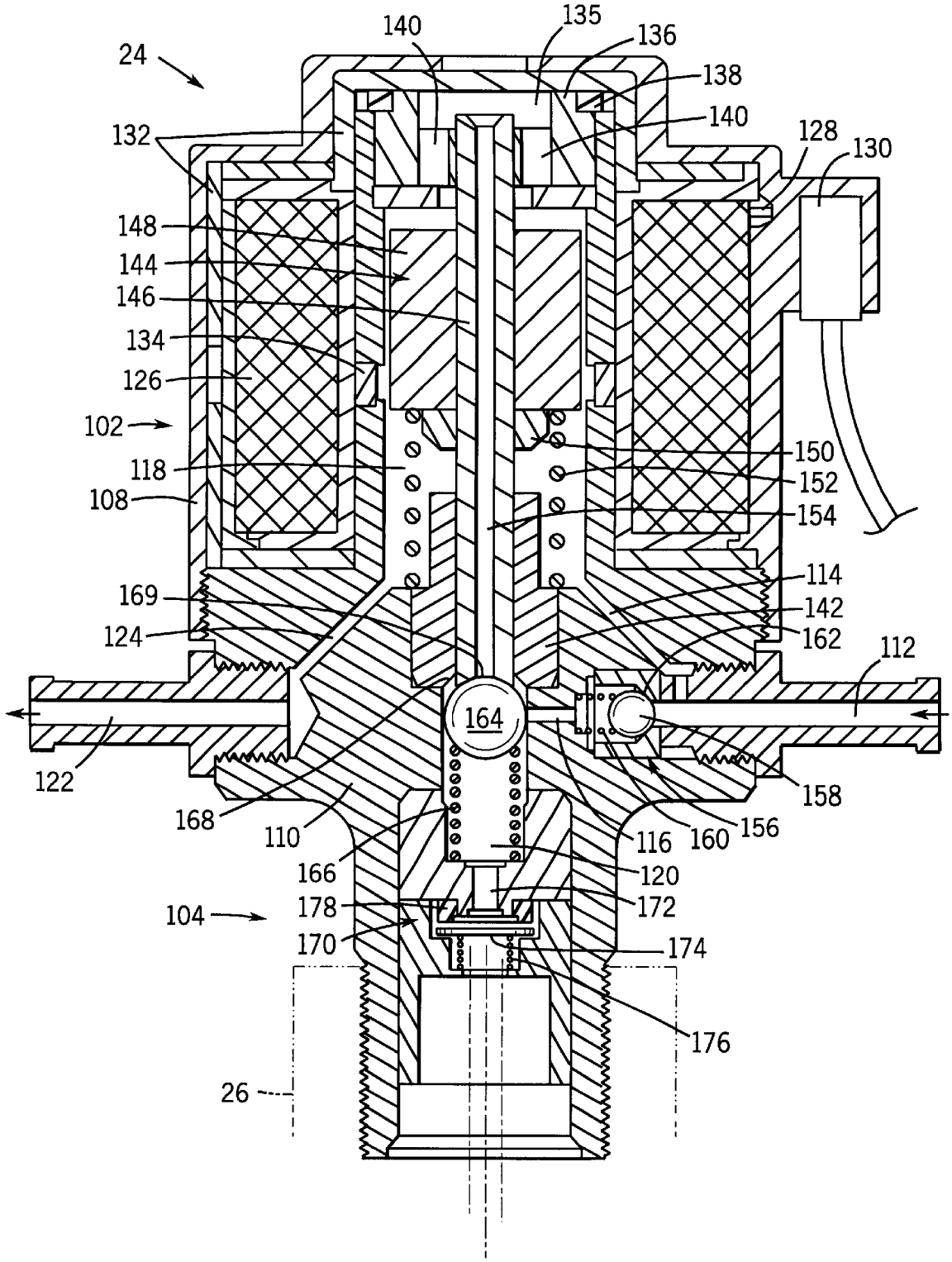
FIG. 3 is a cross-sectional view of a fluid actuator at a point during the discharging cycle in accordance with a preferred embodiment.

Referring generally to FIG. 3, a seal is formed between the guide tube 146 and the pump sealing member 164 when the guide tube 146 contacts the pump sealing member 164. This seal closes the opening to the central passageway 154 from the pump chamber 120. The electromagnetic force driving the armature and guide tube overcomes the force of springs 152 and 166, and drives the pump sealing member 164 into the pump chamber 120. This extension of the guide tube into the pump chamber causes an increase in fuel pressure in the pump chamber 120 that, in turn, causes the inlet check valve assembly 156 to seat, thus stopping the flow of fuel into the pump chamber 120 and ending the charging phase. The volume of the pump chamber 120 will decrease as the guide tube 146 is driven into the pump chamber 120, further increasing pressure within the pump chamber and forcing displacement of the fuel from the pump chamber 120 to the nozzle 106 through an outlet check valve assembly 170. The fuel displacement will continue as the guide tube 146 is progressively driven into the pump chamber 120.

Pressurized fuel flows from the pump chamber 120 through a passageway 172 to the outlet check valve assembly 170. The outlet check valve assembly 170 includes a valve disc 174, a spring 176 and a seat 178. The spring 176 provides a force to seat the valve disc 174 against the seat 178. Fuel flows through the outlet check valve assembly 170 when the force on the pump chamber side of the disc produced by the rise in pressure within the pump chamber is greater than the force placed on the outlet side of the valve disc 174 by the spring 176 and any residual pressure within the nozzle. The injection controller operates the fuel pump driven by a linear electric motor 24 to maintain sufficient pressure to maintain a desired fuel pressure in this common fuel supply.

The injection controller 30 also preferably electrically operates the fluid actuators 28 to create a flow path for fuel from the fuel rail 26 to each cylinder 32. The longer the fluid actuators 28 are open the greater the amount of fuel supplied for each injection cycle. The fuel pump driven by a linear electric motor 24 is sized so that it can provide a sufficient volume of fuel to the fuel rail 26 to satisfy the fuel demand for the internal combustion engine 12. The fuel pump driven by a linear electric motor 24 also maintains fuel pressure such that the desired volume of fuel can flow from the fuel rail 26 into each of the cylinders 32. Additionally, the fluid actuators 28 are configured so that they produce a desired fuel spray pattern for fuel flowing from the fluid actuators 28 into the cylinders 32.

Where desired, a plurality of fluid actuators may be used with each cylinder. A number of factors may influence the number and orientation of the fluid actuators around the cylinder head. These factors may include the desired fuel spray pattern, any spatial constraints, or the desired mode of operation of the system. For example, two fluid actuators could be used to simultaneously provide fuel to the cylinder. This could effectively double the volume of fuel available for combustion as compared to a system employing a single fluid actuator per cylinder. This would also double the flow rate of fuel into the cylinder since fuel is capable of entering the cylinder from two sources simultaneously. Additionally, a wider dispersion of fuel vapor throughout the cylinder could be achieved with fuel injected from two fluid actuators.

Referring to FIG. 4, a cylinder 32 is shown utilizing a single fluid actuator 28 to deliver fuel. The fluid actuator 28 is mounted in a cylinder head 190. Fuel is injected from the fluid actuator 28 in the form of a cone-shaped fuel spray 194. Injecting the fuel in the form of a spray increases the amount of fuel vapor dispersed throughout the cylinder. A spark plug 198 creates a spark to ignite the fuel vapor and produce combustion. A piston 199 in the cylinder is coupled to a drive shaft (not shown). The pressure produced by the combustion drives the piston 199 downward, providing motive force to the drive shaft.

Referring to FIG. 5, a first fluid actuator 28*a* and a second fluid actuator 28*b* may be used to simultaneously deliver fuel to a cylinder 32. The two fluid actuators may be mounted in the cylinder head 190 at positions equidistant from a longitudinal axis through the cylinder. Fuel is injected from the two fluid actuators in the form of a cone-shaped fuel spray 194. Again, a spark plug 198 creates a spark to ignite the fuel vapor and produce combustion.

Figure 6:
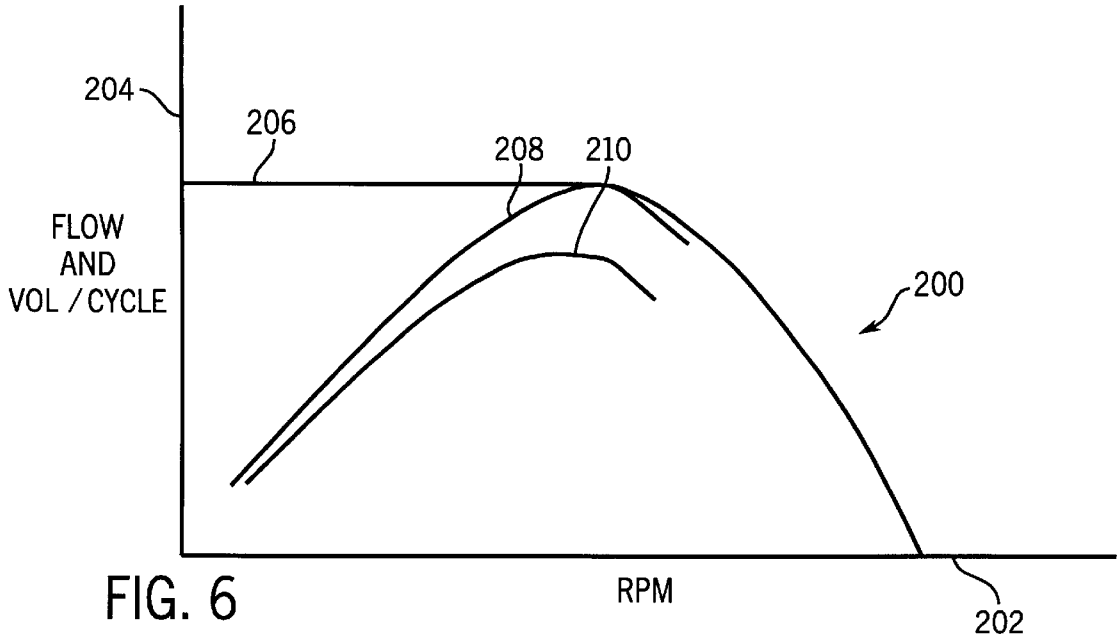
FIG. 6 is a series of graphs illustrating the relationships between the engine power and the flow rate of fuel, and between engine torque and the volume of fuel delivered per engine cycle in an engine using one fluid actuator 40 per cylinder.

Referring to FIG. 6, as will be appreciated by those skilled in the art, the power output by an engine may be represented as a function of the flow rate of fuel combusted. Additionally, the torque of an engine is generally a function of the volume of fuel combusted per engine cycle. A series of graphs 200 are shown to illustrate the relationships between torque, power, fuel flow rate, and fuel volume per engine cycle across a range of engine speeds for an engine utilizing a single injector per cylinder supplied by pressurized fuel from a fuel rail as described above. The horizontal axis 202 in FIG. 6 represents the engine speed in RPM, while the vertical axis 204 represents fuel flow rate and fuel volume per engine cycle.

A first trace 206 of FIG. 6 illustrates the available fuel volume per engine cycle from a single injector on the fuel rail. As illustrated by the trace 206, a single injector can be operated to deliver a given flow rate and flow volume per engine cycle over a substantial range of the rated speed of the engine. At a given point, the injection reaches a delivery limit from which no greater volumetric flow rate or fuel volume per cycle. Thus, trace 206 declines sharply due to such factors as the maximum cycle rate of the injection, flow and mechanical constraints of the injector, and so forth.

A second trace 208 of FIG. 6 is a graph of engine power versus fuel flow rate. Initially, as the engine speed is increased the single injector may be driven to increase the fuel flow rate accordingly. The fuel needs of the engine are thus satisfied, and the entire power curve of the engine, represented by trace 208, is available. A third trace 210 is a graph of engine torque versus fuel volume per cycle. As higher torques are demanded from the engine and higher speeds are obtained, the fuel volume per engine cycle is increased accordingly, following the available torque curve of the engine, represented by trace 210.

Figure 7:
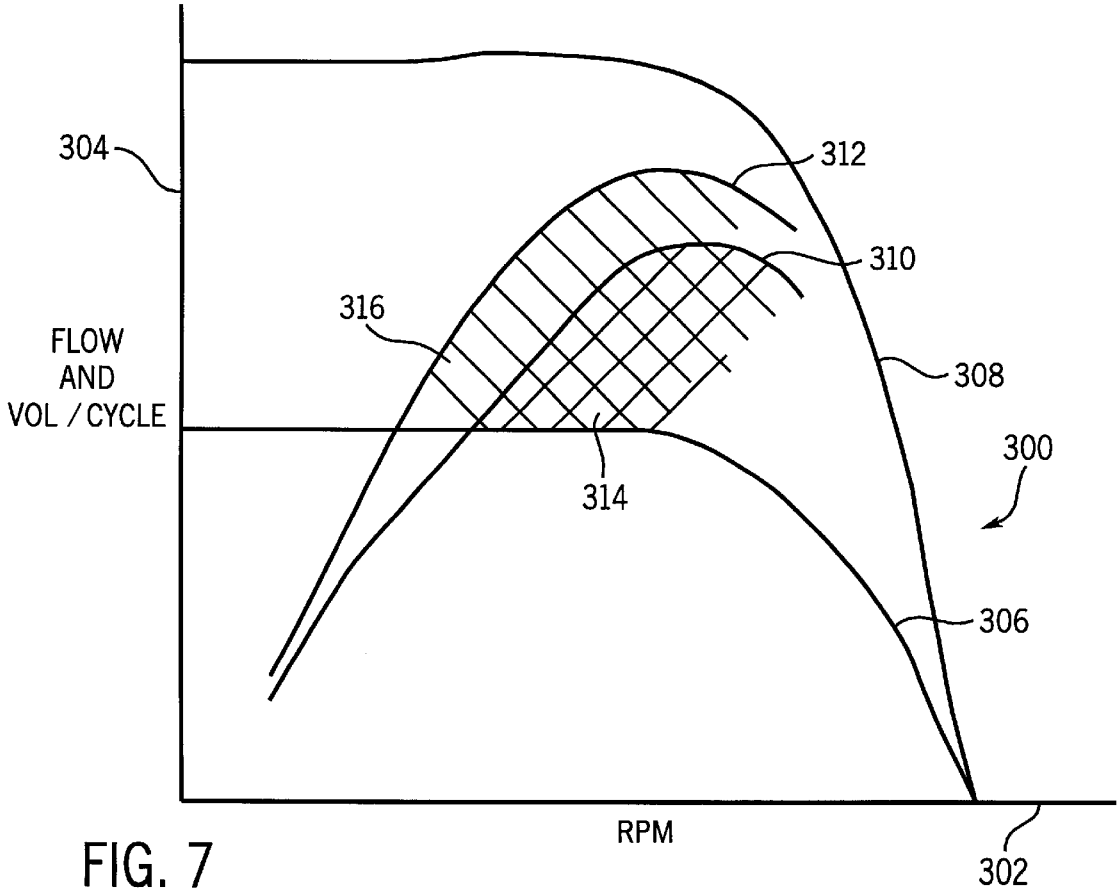
FIG. 7 is a series of graphs illustrating the relationships between the engine power and the flow rate of fuel, and between engine torque and the volume of fuel delivered per engine cycle in an engine using two pump-nozzle assemblies per cylinder.

As will be appreciated by those skilled in the art, the injector, supply pump and fuel rail are generally sized to provide for the torque and power performance of the engine. However, higher performance engines may have higher power and torque capabilities than can be provided by flow rates and fuel flow per cycle ratings of a single injector. FIG. 7 represents an enhanced performance capability obtained through the use of a plurality of injectors for each cylinder, drawing on the common fuel rail as described above.

Referring to FIG. 7, the range of desired engine operation may be such that the fuel flow rate and flow per cycle provided by the above-referenced single injector are insufficient. However, a plurality of injectors allow engines of higher performance to be adequately supplied with fuel by the combined capacities of the injectors, drawing on fuel from the rail. A series of graphs 300 are shown to illustrate the relationships between torque, power, fuel flow rate, and fuel volume per engine cycle across a range of engine speeds for an engine utilizing two injectors per cylinder. Again, the horizontal axis 302 represents the engine speed in RPM, while the vertical axis 304 represents fuel flow rate and fuel volume per engine cycle.

The first trace 306 illustrates the fuel flow rate and volume per engine cycle provided by a single injector. For the purposes of illustration, the performance characteristics of each of the two injectors of FIG. 7 are the same as the single injector of FIG. 6. A second trace 308 represents the available fuel flow rate and volume per engine cycle provided by the operation of two injectors. Of course, the two injectors may have different capacities or may actually be driven to provide different flow rates and flows per cycle, as described above.

A third trace 310 illustrates engine power versus fuel flow rate of an enhanced-performance engine. Initially, as the engine speed is increased the injectors respond to increase the fuel flow rate from the fuel rail. This provides for a corresponding increase in the power available from the engine. However, two injectors can continue to supply an increasing flow rate of fuel beyond the point where a single injector assembly would reach its limit.

Similarly, a fourth trace 312 illustrates torque available from the engine versus fuel volume per cycle. As the fuel volume per engine cycle is increased, the demands of the engine for the maximum available torque are met by the injectors. In the illustrated embodiment, the available volume of fuel per engine cycle is roughly double that of a single injector. The two injectors can continue to supply greater volumes of fuel per injection beyond the point where a single injector would reach its limit.

Figure 8:
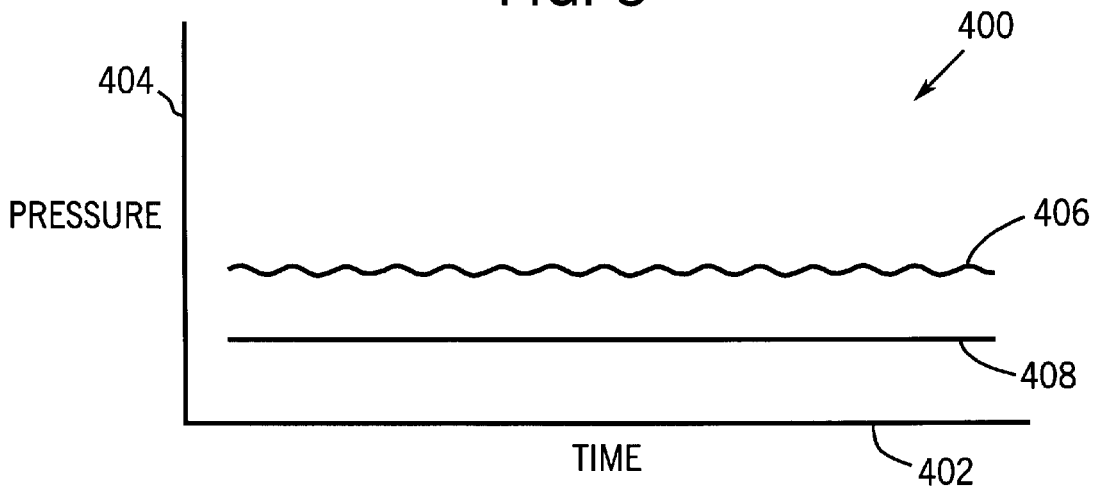
FIG. 8 is a series of graphs illustrating the pressures in the fuel delivery system over time.

Referring to FIG. 8, a pair of traces of fuel pressure 400 are shown for a preferred embodiment of a fuel delivery system using a fuel pump driven by a linear electric motor delivering fuel to a fuel supply rail. In FIG. 8, the horizontal axis 402 represents time of operation and the vertical axis 404 represents pressure. The pressure 406 in the fuel rail may vary over time as the fuel pump driven by a linear electric motor cyclically pumps fuel into the fuel rail, and fuel is removed from the fuel rail by the fluid actuators. The pressure 406 in the fuel rail is, however, greater than the required fuel pressure 408 needed to inject the desired volumes of fuel at desired rates to the cylinders.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fuel delivery system for an internal combustion engine having a plurality of combustion chambers, the system comprising:

a source of fuel;

a fuel pump driven by a linear electric motor and in fluid communication with the source of fuel;

a plurality of fluid actuators, wherein each of the fluid actuators is in fluid communication with the discharge of the fuel pump;

a plurality of fuel delivery assemblies, wherein each of the fuel delivery assemblies is in fluid communication with at least one fluid actuator and with a respective combustion chamber; and a control system, coupled to the fluid actuators for controlling the operation of the fuel delivery system.

2. The system as recited in claim 1, wherein each of the fuel delivery assemblies is in fluid communication with a plurality of fluid actuators.

3. The system as recited in claim 1, wherein each of the combustion chambers is in fluid communication with a plurality of fuel delivery assemblies.

4. The system as recited in claim 1, each fluid actuator further comprising an electrically operable valve in the fuel flow path.

5. The system as recited in claim 4, wherein the control system operates the electrically operable valves to provide desired volumes of fuel for delivery to the plurality of combustion chambers.

6. The system as recited in claim 4, wherein the control system operates the electrically operable valves to provide desired flow rates of fuel for delivery to the plurality of combustion chambers.

7. The system as recited in claim 1, wherein the control system operates the linear electric motor in the fuel pump to vary the pressure of the fuel supplied by the fuel pump to the plurality of fluid actuators.

8. The system as recited in claim 1, wherein the control system includes a programmable digital circuit.

9. The system as recited in claim 1, wherein the fuel pump is a pressure surge pump.

10. The system as recited in claim 9, wherein the pressure surge pump produces a fuel system pressure that varies with each pressure surge cycle above a base system pressure.

11. The system as recited in claim 1, wherein at least one fuel delivery assembly for each ofthe combustion chambers injects fuel directly into the respective combustion chamber.

12. The system as recited in claim 1, wherein each of the fuel delivery assemblies includes a nozzle assembly, and further wherein each nozzle assembly is operated by the fluid pressure of the fuel provided by a fluid actuator.

13. An internal combustion engine, comprising:

a source of fuel;

a common fuel supply line;

a fuel pump driven by a linear electric motor, wherein the fuel pump intakes fuel from the source of fuel and discharges the fuel to the common fuel supply line;

a plurality of fluid actuators wherein each of the plurality of fluid actuators is fluidly coupled to the common fuel supply line;

a plurality of combustion chambers;

a plurality of fuel delivery assemblies, wherein each of the fuel delivery assemblies receives fuel from a fluid actuator and delivers the fuel to a respective combustion chamber; and a control system that controls the operation of the fuel delivery system to provide fuel to the plurality of combustion chambers.

14. The system as recited in claim 13, wherein each of the fuel delivery assemblies is in fluid communication with a plurality of fluid actuators.

15. The system as recited in claim 13, wherein each of the combustion chambers is in fluid communication with a plurality of fuel delivery assemblies.

16. The system as recited in claim 13, each fluid actuator further comprising an electrically operable valve in the fuel flow path.

17. The system as recited in claim 16, wherein the control system operates the electrically operable valves to provide desired volumes of fuel to the plurality of combustion chambers.

18. The system as recited in claim 16, wherein the control system operates the electrically operable valves to provide desired flow rates of fuel to the plurality of combustion chambers.

19. The system as recited in claim 18, wherein the linear electric motor in the fuel pump is a reluctance motor.

20. A method for supplying fuel to an internal combustion engine, the method comprising the steps of:

operating a linear electric motor to drive a fuel pump to pump fuel from a source of fuel to a common fuel supply line; and operating the plurality of fluid actuators coupled to the common fuel supply line to provide desired fuel flow rates or fuel volumes from the common fuel supply line to a plurality of combustion chambers for combustion.

21. The method as recited in claim 20, further comprising operating a plurality of fluid actuators to provide desired fuel flow rates or fuel volumes to each of the respective combustion chambers.

22. The method as recited in claim 21, further comprising operating a single fluid actuator to provide a first range of fuel flow rates or fuel volumes to a respective combustion chamber and a plurality of fluid actuators to provide a second range of fuel flow rates or fuel volumes to a respective combustion chamber.

23. The method as recited in claim 22, further comprising the step of combining flow of fuel from the plurality of fluid actuators in a single fuel delivery assembly for delivery to a respective combustion chamber.

24. The method as recited in claim 20, further comprising operating the plurality of fuel delivery assemblies to inject fuel directly into each of the combustion chambers.

25. The method as recited in claim 20, wherein the linear electric motor is a reluctance motor.

* * * * *